US012234703B1

(12) United States Patent
Schmidt et al.

(10) Patent No.: US 12,234,703 B1
(45) Date of Patent: Feb. 25, 2025

(54) WELLBORE PLUG AND WELLBORE ASSEMBLY WITH PLUG HAVING A PASSIVE NON-ROTATION MECHANISM

(71) Applicant: Citadel Casing Solutions, LLC, Houston, TX (US)

(72) Inventors: Daniel Lee Schmidt, Magnolia, TX (US); Todd Anthony Stair, Conroe, TX (US); Gary J. Makowiecki, Spring, TX (US)

(73) Assignee: Citadel Casing Solutions LLC, Houston, TX (US)

( * ) Notice: Subject to any disclaimer, the term of this patent is extended or adjusted under 35 U.S.C. 154(b) by 0 days.

(21) Appl. No.: 18/607,173

(22) Filed: Mar. 15, 2024

(51) Int. Cl.
*E21B 33/16* (2006.01)
*E21B 34/10* (2006.01)

(52) U.S. Cl.
CPC ..... *E21B 34/10* (2013.01); *E21B 33/167* (2020.05)

(58) Field of Classification Search
CPC ..... E21B 33/08; E21B 33/126; E21B 33/167; E21B 34/10
See application file for complete search history.

(56) References Cited

U.S. PATENT DOCUMENTS 5,234,052 A * 8/1993 Coone ..... E21B 21/10 166/155
5,246,069 A * 9/1993 Glaser ..... E21B 33/1204 166/155
11,767,728 B2 * 9/2023 Dharne ..... E21B 33/12 166/285

* cited by examiner

*Primary Examiner* — Tara Schimpf
*Assistant Examiner* — Lamia Quaim
(74) *Attorney, Agent, or Firm* — AVEK IP, LLC

(57) ABSTRACT

A plug for use in wellbore operations includes a plug body extending from a top end to a bottom end; a sealing member as part of the plug body and positioned at the bottom end; and a non-rotating profile positioned at the bottom end of the plug body; the sealing member protrudes past the non-rotating profile such that the sealing member comes into contact with a surface when the plug is dropped into a well before the non-rotating profile.

17 Claims, 13 Drawing Sheets

WELLBORE PLUG AND WELLBORE ASSEMBLY WITH PLUG HAVING A PASSIVE NON-ROTATION MECHANISM

FIELD OF THE DISCLOSURE

The disclosure relates generally to plugs and wellbore assemblies. More specifically, the disclosure relates to a wellbore plug having a passive non-rotation mechanism configured to reduce the need for non-rotating profiles, making the plug more universally usable within the industry.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a plug for use in wellbore operations, the plug comprising a plug body extending from a top end to a bottom end; a sealing member as part of the plug body and positioned at the bottom end; and a non-rotating profile positioned at the bottom end of the plug body; wherein the sealing member protrudes past the non-rotating profile such that the sealing member comes into contact with a surface when the plug is dropped into a well before the non-rotating profile.

In other aspects, the present invention relates to a wellbore assembly, comprising an apparatus run into and secured within a well, the apparatus having a landing surface and a first non-rotating profile recessed below the landing surface; a plug configured to run into the well above the apparatus, the plug having a plug body extending from a top end to a bottom end; a sealing member as part of the plug body and positioned at the bottom end; and a second non-rotating profile positioned at the bottom end of the plug body. The sealing member protrudes past the second non-rotating profile; the sealing member comes into contact with the landing surface and seals against the landing surface; and the second non-rotating profile is configured to engage with the first non-rotating profile once pressure is applied to the plug, the sealing member depressing against the landing surface due to the pressure.

In yet another aspect, the present invention relates to a wellbore assembly, comprising an apparatus run into and secured within a well, the apparatus having a landing surface without a non-rotating profile; a plug configured to run into the well above the apparatus, the plug having a plug body extending from a top end to a bottom end; and a sealing member as part of the plug body and positioned at the bottom end. The sealing member comes into contact with the landing surface and seals against the landing surface.

BRIEF DESCRIPTION OF THE SEVERAL VIEWS OF THE DRAWINGS

Illustrative embodiments of the present disclosure are described in detail below with reference to the attached drawing figures.

LIST OF REFERENCE NUMBERS

Figure 1:
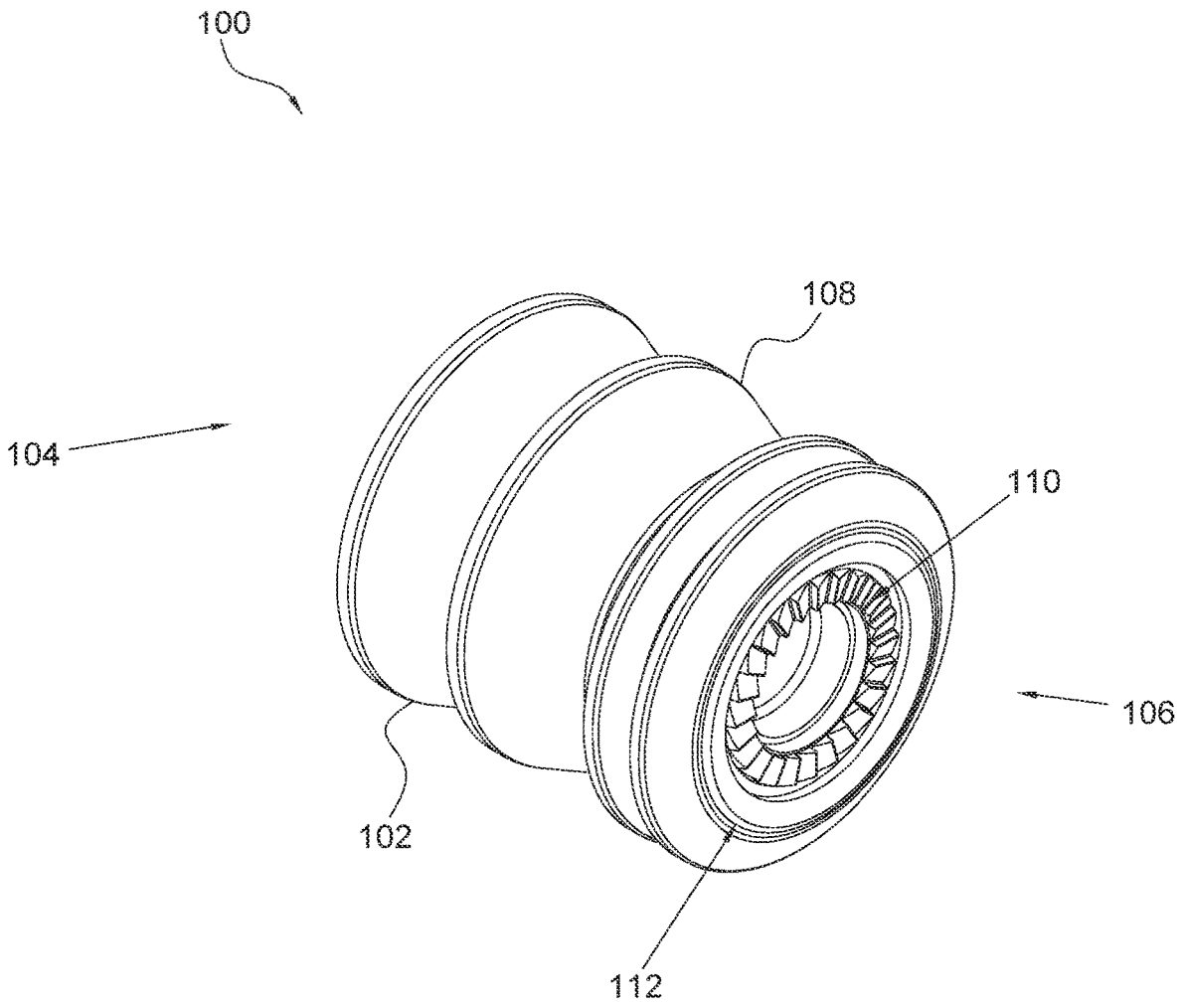
FIG. 1 is an angled end view of a top plug having a passive non-rotation mechanism in accordance with the present invention.

100—Top Plug
102—Plug Body
104—Top End
106—Bottom End
108—Fins
110—Male Non-Rotating Profile
112—Sealing Member
200—Teeth
300—Plane of Non-Rotating Profile
400—Plug
402—Male Non-Rotating Profile
404—Sealing Member
406—Well
407—Apparatus
408—Female Non-Rotating Profile
410—Landing Surface
412—Teeth
500—Valve Assembly
502—Stem
504—Poppet
506—Spring Housing
508—Spring
510—Valve Housing
600—Gap
800—Apparatus
802—Valve Assembly
804—Flat Face
1000—First Elastomeric Protruding Ring
1002—Second Elastomeric Protruding Ring
1100—Bottom Plug
1101—Plug Body

1102—Female Non-Rotating Profile
1103—Fins
1104—Top End
1300—Sealing Member
1302—Non-Rotating Profile The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. This complex industry utilizes a plurality of tools and assemblies in preparing a well for extraction of oil and/or gas from the formation surrounding the well. Cementing plugs are known in the art and used for a plurality of well operations. Many cementing plugs include a non-rotating profile that extends from an end of the plug, and then engages with a corresponding mating mechanism, such as within a landing collar. In other words, a male non-rotating profile extends from the plug and drops into a female non-rotating profile of a collar, such that rotation is then prevented. Without a non-rotating profile, the plug is subject to spinning, particularly when being drilled out, which can increase drill out time and reduce overall efficiencies of the system. This conventional mechanism also requires that corresponding male and female non-rotating profiles be used together, as opposed to more universally useable tools.

The present invention provides for a plug having a non-rotating profile that does not protrude past the associated end of the plug, and accordingly, the non-rotating profile requires weight or pressure to engage with a corresponding non-rotating profile. The plug further includes a sealing member, which also extends past a plane of the non-rotating profile, and therefore is configured to create a seal against a landing surface prior to engagement of the corresponding non-rotating profiles. Accordingly, the plug of the present invention is more widely useable, as the plug can function as a non-rotating profile plug or as a standard plug, as the non-rotating profile does not impede the plug from sealing against a flat surface. Accordingly, the plug can land on a purpose built landing collar with a corresponding non-rotating profile, or on a standard float collar lacking a non-rotating profile and having a flat face.

Figure 2:
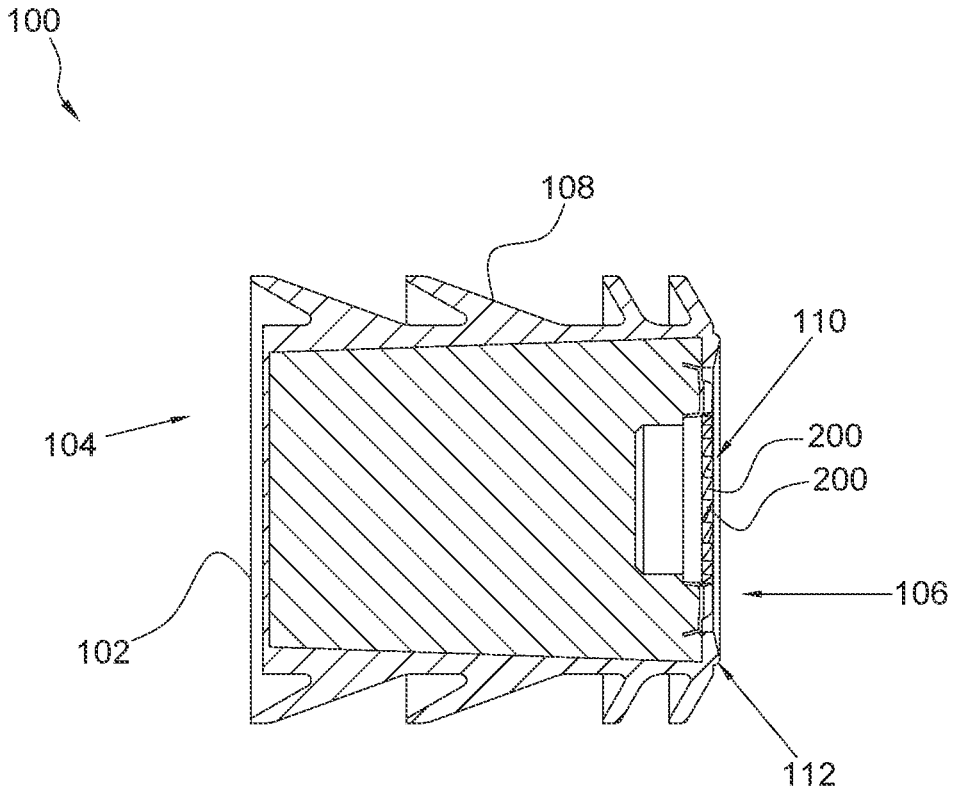
FIG. 2 is a side cross sectional view of the top plug of FIG. 1.
Figure 3:
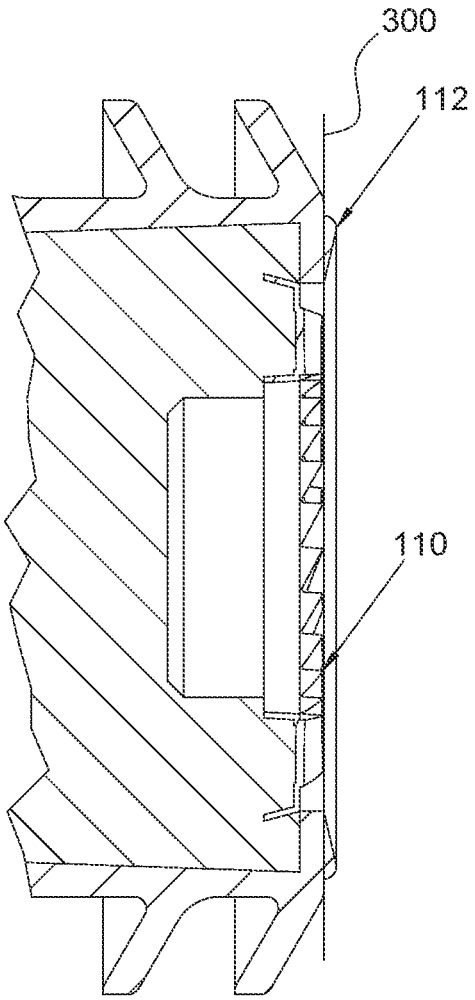
FIG. 3 is a close up, side cross sectional view of a portion of the top plug of FIG. 1.

In FIGS. 1-3, a top plug 100 in accordance with the present invention is shown. Top plug 100 includes a plug body 102 extending from a top end 104 to a bottom end 106 and supporting a plurality of fins 108 as is known in the art. The bottom end 106 further includes a sealing member 112 and a non-rotating profile 110. It should be appreciated that the non-rotating profiles discussed herein, may be designated as male or female, however those skilled in the art will appreciate that the exact style and configuration of the non-rotating profiles may vary, so long as the system includes corresponding profiles, such that interlocking prevents rotation of the plug or other apparatus. In embodiments, the non-rotating profile 110 includes a plurality of angled teeth 200 arranged into a circle, as shown. The sealing member 112 may vary but extends past a plane of the non-rotating profile 300, as shown best in FIG. 3. In other words, the sealing member 112 is created such that it will be the first surface to engage with a landing surface, thereby creating a seal thereagainst. In embodiments, the sealing member 112 is integral with the plug body 102 and is composed of an elastomeric material.

Figure 4:
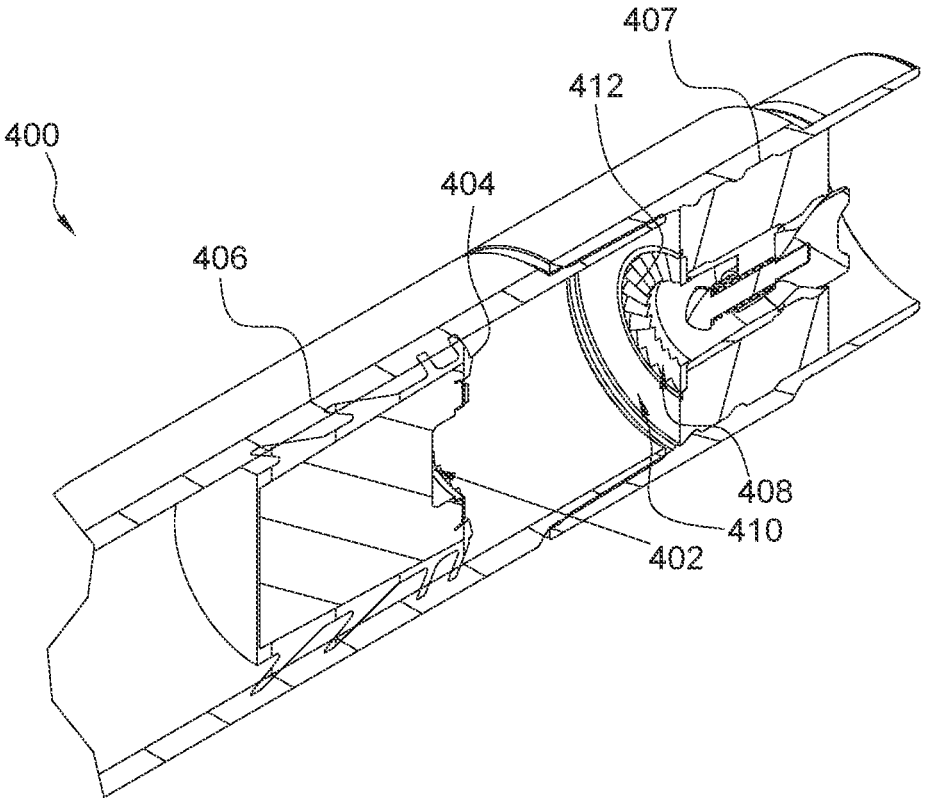
FIG. 4 is an angled view of a plug having a passive non-rotation mechanism and a lower apparatus having a landing surface for engaging with the plug.

In FIG. 4, a plug 400 is shown, which in embodiments is the same as top plug 100, however the plug 400 could also be considered a bottom plug and may include various or alternative features. Regardless, the plug 400 includes a non-rotating profile 402 and sealing member 404 as discussed above. FIG. 4 demonstrates an apparatus 407 positioned within the well 406. The apparatus 407 can vary as would be understood by those skilled in the art and in embodiments includes a non-rotating profile 408 and a landing surface 410. The non-rotating profile 408 having angled teeth 412 that correspond with the non-rotating profile 402 of the plug 400. Accordingly, once the plug 400 is dropped into the well, the sealing member 404 will first come into contact with landing surface 410.

Figure 5:
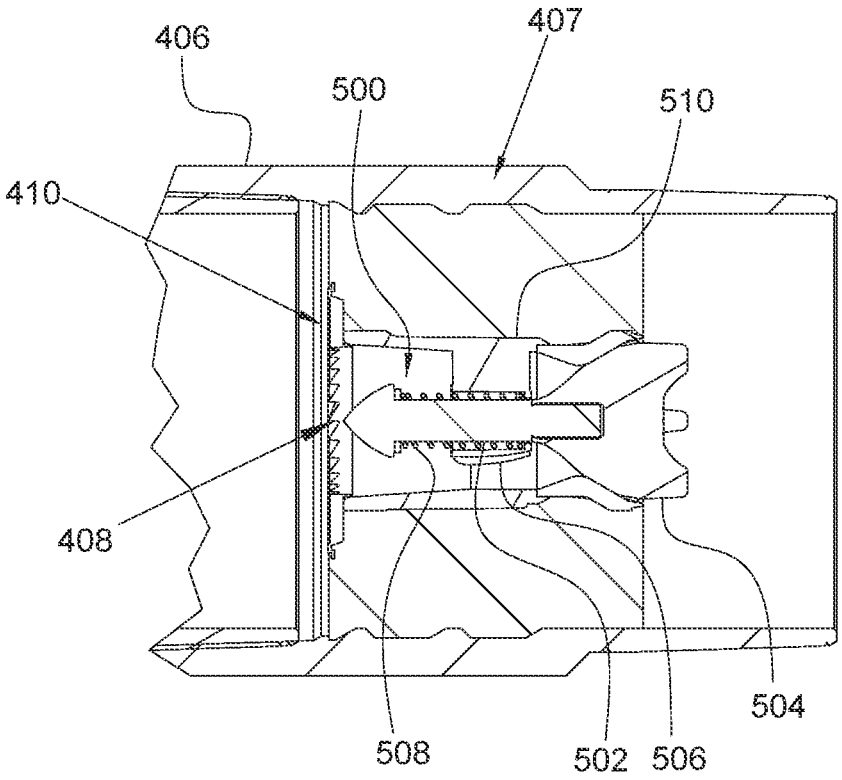
FIG. 5 is a side cross sectional view of an exemplary embodiment of the lower apparatus of FIG. 4.

In FIG. 5, the apparatus 407 is shown, wherein the apparatus 407 is a valve assembly 500 having a stem 502 coupled to a poppet 504, with a spring 508 at least partially surrounding the stem 502, and a spring housing 506. Those skilled in the art will again appreciate that the exact configuration of the apparatus 407 and valve assembly 500 can vary.

Figure 6:
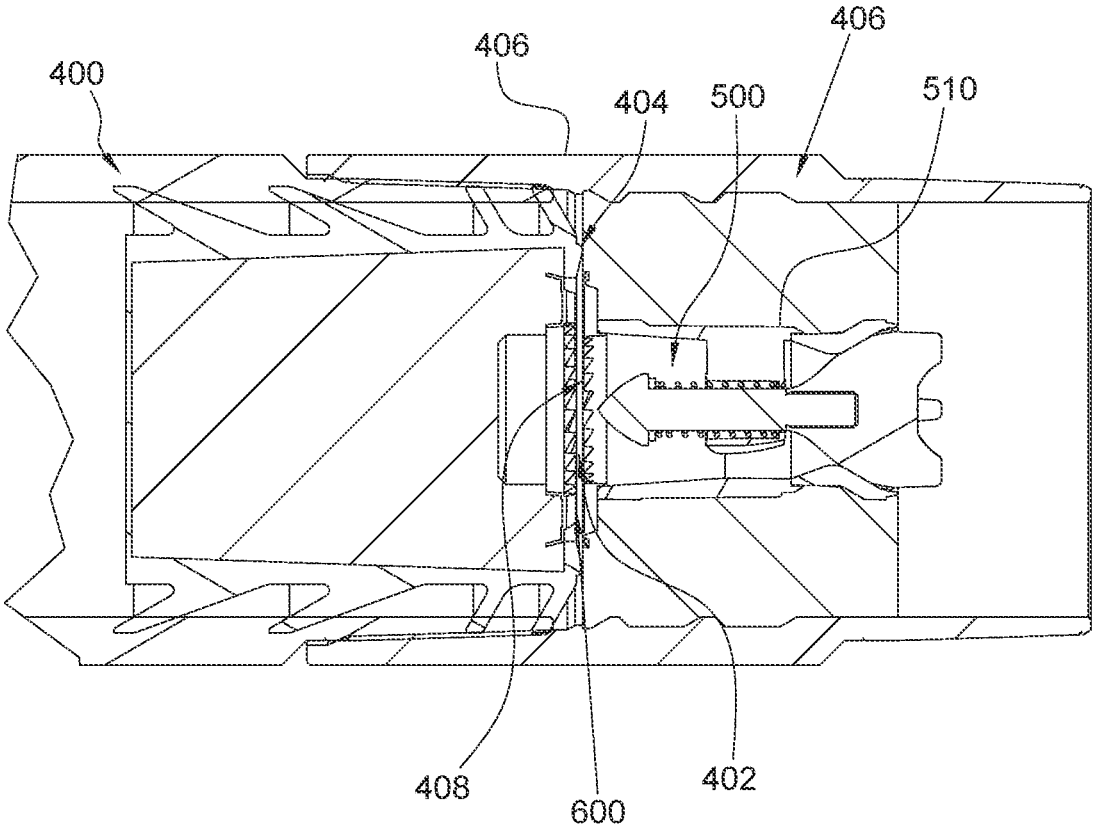
FIG. 6 is a side cross sectional view of the plug and lower apparatus of FIG. 4 before pressure is applied to the plug.
Figure 7:
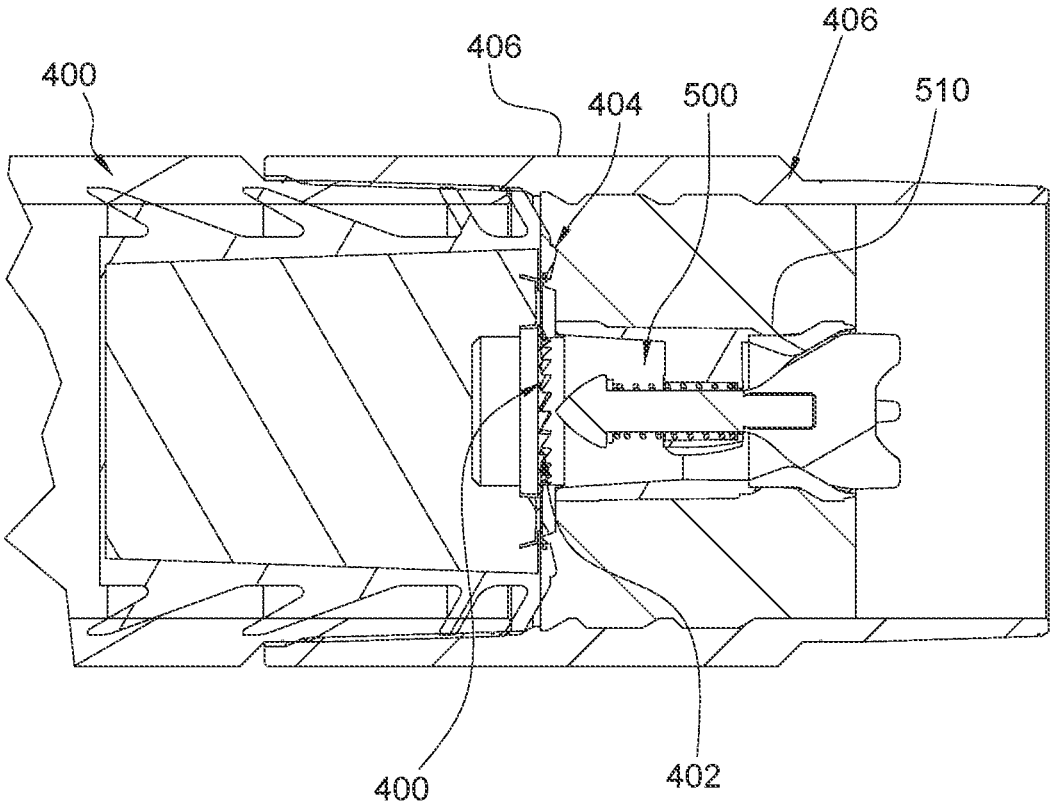
FIG. 7 is a side cross sectional view of the plug and lower apparatus of FIG. 4 after pressure is applied to the plug such that a non-rotating profile of the plug and a non-rotating profile of the lower apparatus engage.

Turning to FIG. 6, the plug 400 is dropped into the well 406 and travels downhole until abutting with the apparatus 406. As shown, the sealing member 404 comes into direct contact with the landing surface 410. At this stage, a gap 600 is still between the two non-rotating profiles 402, 408. In FIG. 7, pressure or weight from a drill bit is applied to the plug 400 such that the sealing member 404 depresses into the landing surface 410 until the non-rotating profiles 402, 408 engage as shown.

Figure 8:
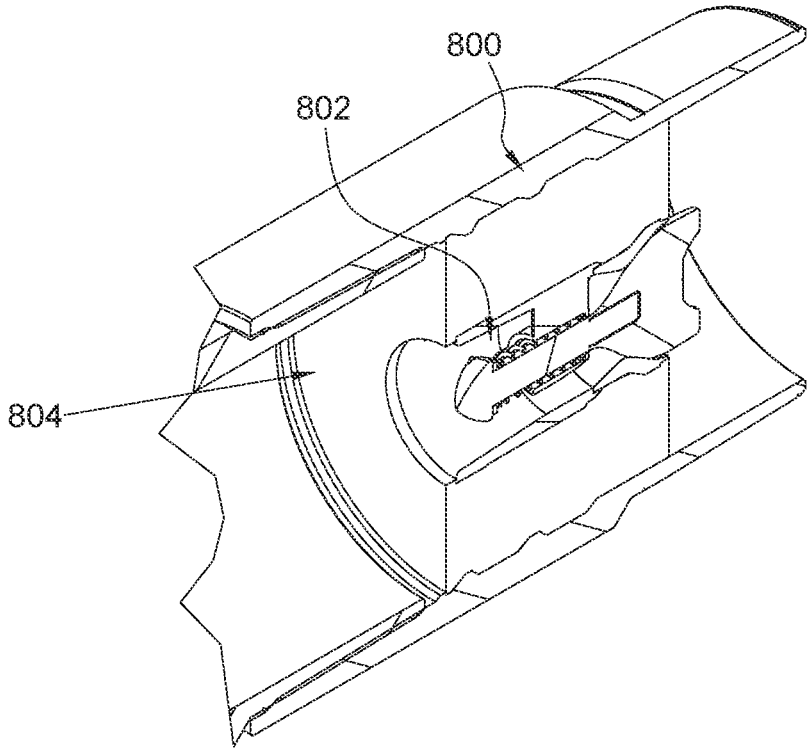
FIG. 8 is an angled view of an alternative embodiment of a lower apparatus having a flat face and lacking a non-rotating profile.
Figure 9:
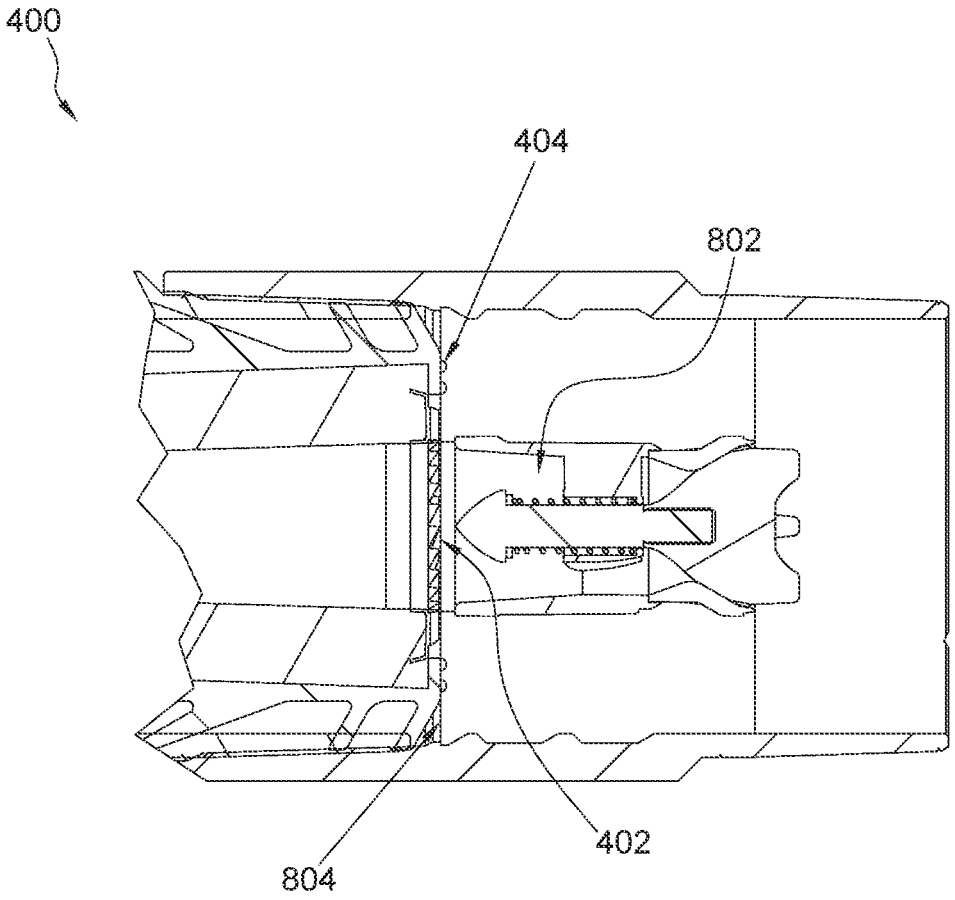
FIG. 9 is a side cross sectional view of the lower apparatus of FIG. 8 and a plug having a passive non-rotation mechanism.
Figure 10:
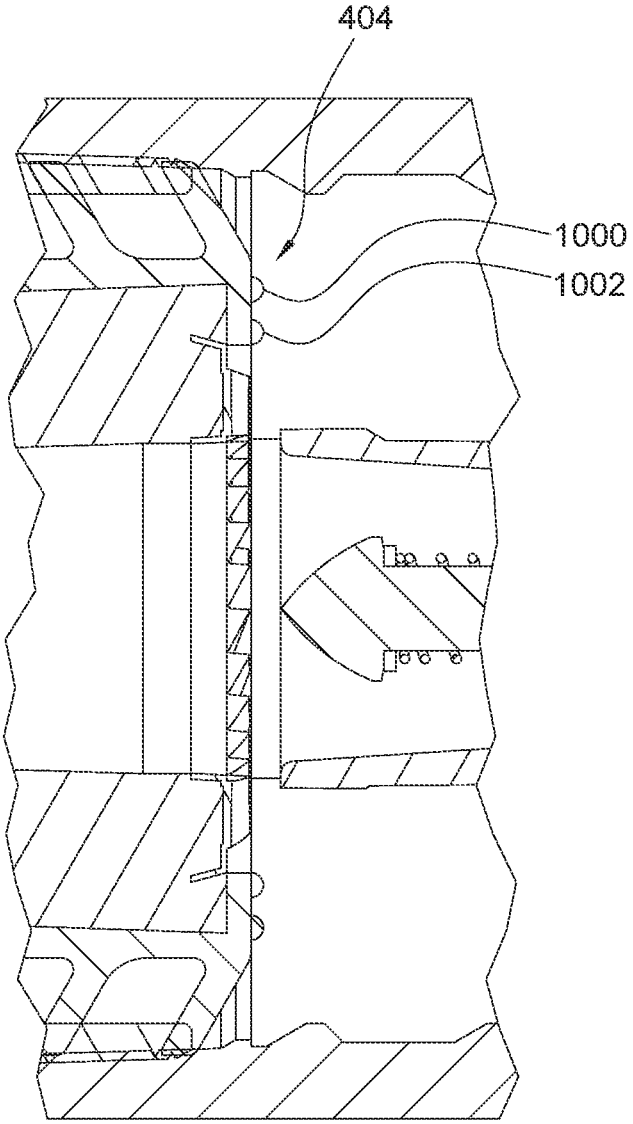
FIG. 10 is a close up, side cross sectional view showing the plug and the lower apparatus of FIG. 9 wherein the sealing member is pressed into the flat face.

In FIG. 8, an alternative embodiment of an apparatus 800 is shown, again being a valve assembly 802 but not being limited to any particular apparatus or configuration. Here, a flat face 804 is provided, without a non-rotating profile. As shown in FIG. 9, the plug 400 can still seal against the flat face 804 due to the sealing member 404, and the non-rotating profile 402 does not hinder the use due to being recessed behind the sealing member 404. In FIG. 10, a close-up view shows the sealing member 404 against the flat face 804. Again, the sealing member 404 can vary, but in some embodiments includes a first elastomeric ring 1000. Embodiments may include a plurality of elastomeric rings.

Figure 11:
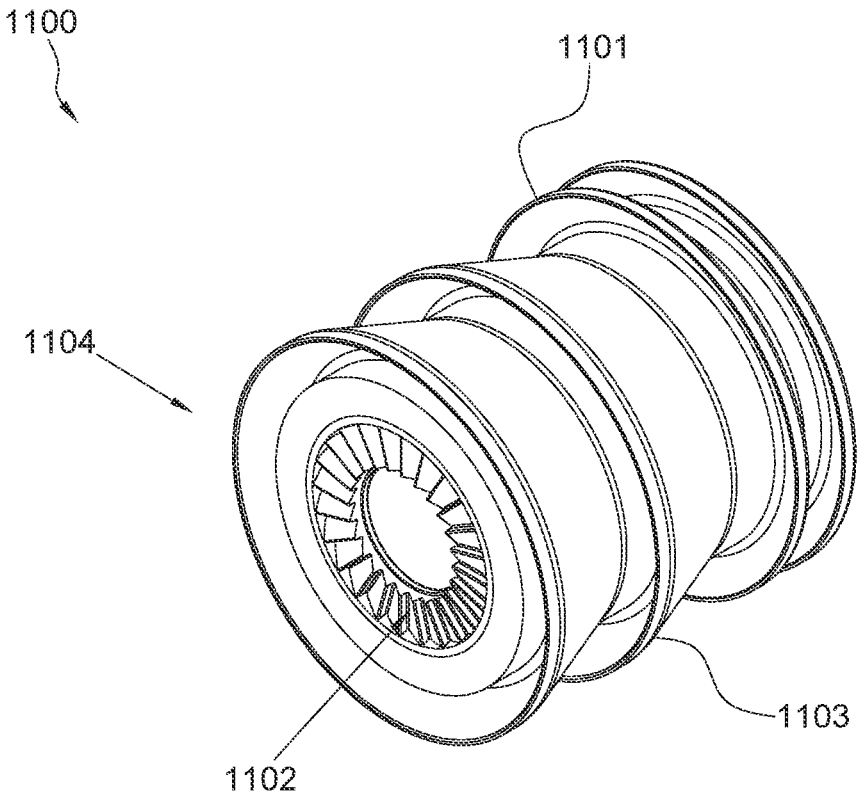
FIG. 11 is an angled end view of a bottom plug having a non-rotating profile.
Figure 12A:
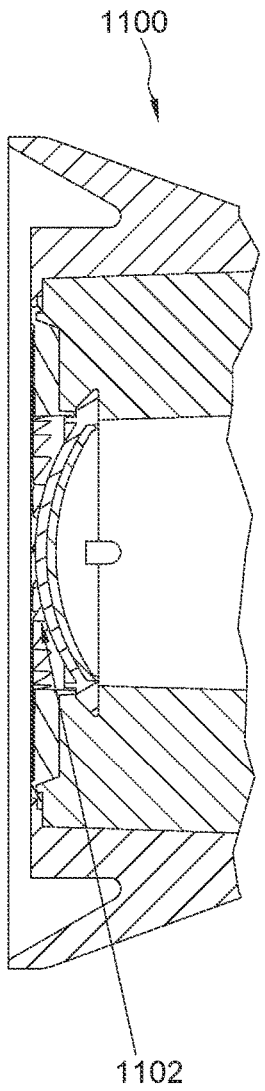
FIGS. 12A, 12B, and 12C are side cross-sectional views showing the bottom plug of FIG. 11 in a series of steps of engagement with the top plug of FIG. 1.
Figure 12B:
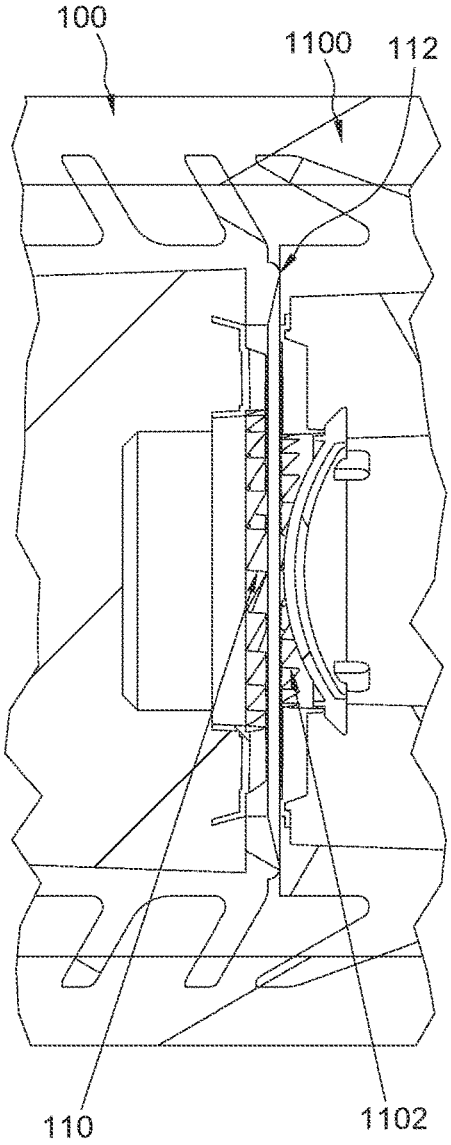
Figure 12C:
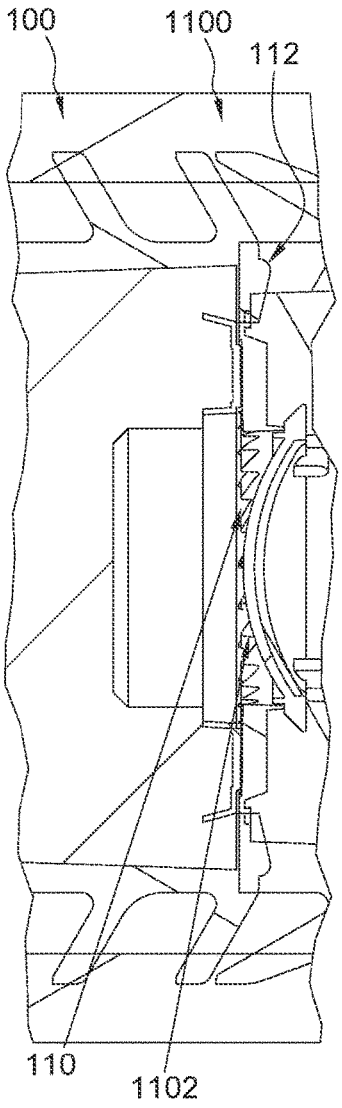

In FIG. 11, a bottom plug 1100 is shown, incorporating the teachings from above. The bottom plug 1100 having a plug body 1101 with fins 1103 as known in the art. Here, a top end 1104 includes a non-rotating profile 1102. In FIGS. 12A, 12B, and 12C, a series of steps show the top plug 100 engaging with the bottom plug 1100. Specifically, in FIG. 12A, the bottom plug 1100 is already positioned within the well. In FIG. 12B, the top plug 100 has been dropped and the sealing member 112 comes into contact with the bottom plug 1100. Then finally, in FIG. 12C, when weight is applied to the top plug 100, the non rotating profiles 110, 1102 engage.

Figure 13:
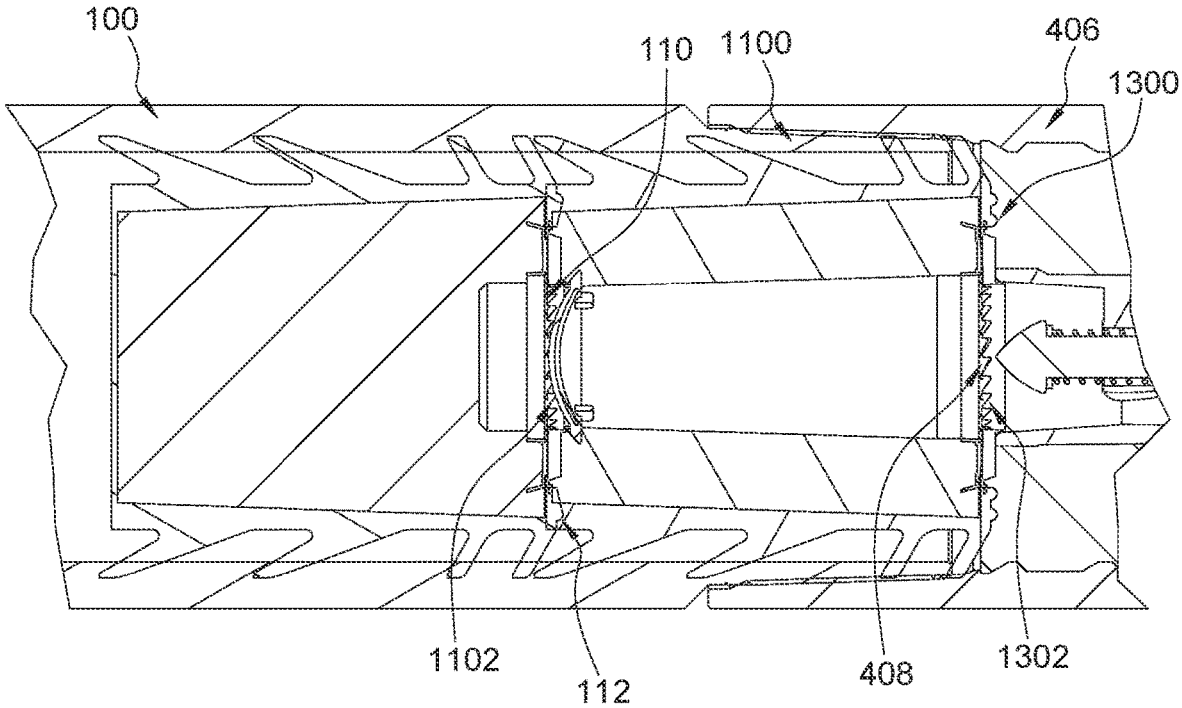
FIG. 13 is a side cross-sectional view showing the top plug of FIG. 1, the bottom plug of FIG. 11, and a lower apparatus all engaged in accordance with an embodiment of the present invention.

Finally, turning to FIG. 13, an entire wellbore assembly is shown, having the lower apparatus 406, the bottom plug 1100, and the top plug 100. Again, after weight or pressure is applied, the non rotating profiles 1102, 110, 408, 1302 all engage. Prior to the weight or pressure, the sealing members 112, 1300 create seals against the associated surfaces.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A plug for use in wellbore operations, the plug comprising:

a plug body extending from a top end to a bottom end;

a sealing member positioned at the bottom end of the plug body, the sealing member being composed of an elastomeric material; and a non-rotating profile positioned at the bottom end of the plug body;

wherein the sealing member protrudes past the non-rotating profile such that the sealing member comes into contact with a surface before the non-rotating profile;

wherein the sealing member is configured to depress against the surface until the sealing member no longer protrudes past the non-rotating profile; and wherein depression of the sealing member until the sealing member no longer protrudes past the non-rotating profile is required for the non-rotating profile to be engageable with a downhole apparatus.

2. The plug of claim 1, wherein the sealing member further comprises one or more rings protruding from the bottom end of the plug body.

3. The plug of claim 1, wherein the non-rotating profile further comprises a plurality of teeth configured to mate with a second plurality of teeth associated with an apparatus within the well before the plug is launched into the well.

4. The plug of claim 3, wherein the plurality of teeth are arranged in a circle.

5. The plug of claim 1, wherein the sealing member and the non-rotating profile are separate structures and wherein the sealing member is in a circular shape and surrounds a periphery of the non-rotating profile.

6. The plug of claim 1, wherein the sealing member, due to being composed of the elastomeric material, is configured to change shape as the sealing member is depressed.

7. A wellbore assembly, comprising:

an apparatus run into and secured within a well, the apparatus having a landing surface;

a plug configured to run into the well above the apparatus, the plug having:

a plug body extending from a top end to a bottom end;

a sealing member positioned at the bottom end of the plug body, the sealing member composed of an elastomeric material; and a first non-rotating profile positioned at the bottom end of the plug body;

wherein the sealing member protrudes past the first non-rotating profile;

wherein the sealing member comes into contact with the landing surface and is configured to depress against the landing surface;

wherein depression of the sealing member until the sealing member no longer protrudes past the first non-rotating profile is required for the non-rotating profile to be engageable with the apparatus; and wherein an application of pressure or weight to the plug is required in order for the sealing member to depress against the landing surface.

8. The wellbore assembly of claim 7, wherein the sealing member further comprises one or more rings protruding from the bottom end of the plug body.

9. The wellbore assembly of claim 7, wherein the first non-rotating profile further comprises a first plurality of teeth.

10. The wellbore assembly of claim 9, wherein the first plurality of teeth is arranged into a circle.

11. The wellbore assembly of claim 7, wherein the plug further comprises a second non-rotating profile positioned at the top end.

12. The wellbore assembly of claim 11, further comprising a top plug having a second sealing member positioned at a bottom end of the top plug, the second sealing member configured to seal against the top end of the plug when the top plug is dropped into the well.

13. The wellbore assembly of claim 12, wherein the top plug further comprises a third non-rotating profile configured to engage with the second non-rotating profile when pressure is applied to the top plug such that the second sealing member is depressed into the top end of the plug.

14. The wellbore assembly of claim 7, wherein the apparatus comprises a valve assembly having a valve housing with a valve stem coupled to a poppet positioned within the valve housing.

15. The wellbore assembly of claim 7, wherein the sealing member and the first non-rotating profile are separate structures and wherein the sealing member is in a circular shape and surrounds a periphery of the first non-rotating profile.

16. The wellbore assembly of claim 7, wherein the apparatus further comprises a second non-rotating profile and wherein the first non-rotating profile will engage with the second non-rotating profile only after the sealing member is depressed due to pressure or weight.

17. The wellbore assembly of claim 7, wherein the sealing member, due to being composed of the elastomeric material, is configured to change shape as the sealing member is depressed against the landing surface.

* * * * *